US006095678A

United States Patent [19]

Meili et al.

[11] Patent Number: 6,095,678

[45] Date of Patent: Aug. 1, 2000

[54] METHOD OF CALIBRATING A THERMAL TRIGGER FOR AN ELECTRICAL SWITCHING DEVICE

[75] Inventors: Hans-Peter Meili, Seon; Karin Hannelore Spengler-Schmid; Stephan Spengler, both of Siblingen, all of Switzerland

[73] Assignee: Rockwell Technologies, LLC, Thousand Oaks, Calif.

[21] Appl. No.: 08/929,617

[22] Filed: Sep. 15, 1997

[30] Foreign Application Priority Data

Jun. 11, 1997 [CH] Switzerland ..... 1422/97

[51] Int. Cl.[7] ..... G12B 1/02; H01H 61/02; H01H 69/01; H01H 11/00

[52] U.S. Cl. ..... 374/1; 337/94; 337/360

[58] Field of Search ..... 374/1; 337/94, 337/360

[56] References Cited

U.S. PATENT DOCUMENTS

| | | | |
|---|---|---|---|
| Re. 27,024 | 1/1971 | Whiting et al. | 337/3 X |
| 3,870,985 | 3/1975 | Hire | 337/360 X |
| 4,157,523 | 6/1979 | Bollinger, Jr. et al. | 337/56 |
| 4,249,154 | 2/1981 | Grable | 337/360 |
| 4,337,451 | 6/1982 | Fox | 337/93 |
| 4,691,184 | 9/1987 | Wulff | 337/82 X |
| 4,864,102 | 9/1989 | Slack | 337/3 X |
| 4,914,414 | 4/1990 | Ubukata | 337/368 |
| 4,931,762 | 6/1990 | Fierro | 337/74 X |
| 5,191,310 | 3/1993 | Obermann et al. | 337/82 X |
| 5,825,273 | 10/1998 | Roger | 337/82 X |

FOREIGN PATENT DOCUMENTS

| | | |
|---|---|---|
| 302822 | 2/1989 | European Pat. Off. . |
| 1 271 618 | 1/1962 | France . |
| 2 667 979 | 4/1992 | France . |

*Primary Examiner*—Thomas P. Noland
*Attorney, Agent, or Firm*—John J. Horn; William R. Walbrun; David G. Luettgen

[57] ABSTRACT

A method of calibrating a thermal trigger for an electrical switching device starts with fastening bimetal strips (1) for each phase in the housing of the trigger. Thereafter, the bimetal strips (1) are heated-up with a predetermined calibration current for a predetermined time, and are thus brought into a calibrated position. In the calibrated position, the positioning of each of the free end sections of each bimetal strip (1) is measured on both folded ends opposite each other. Then, two slides (3,4) are fitted with two hinged drive arms (5,6) and are retained in a calibration device. Stops (9) bring the drive arms (5,6) into the previously measured calibrated position of the assigned bimetal strip (1) by sluing. In the calibrated position, the other single-piece arms (8) with the trigger arms (5,6) are attached to the slide (3,4). The slides (3,4) that are provided with rigid drive arms (5,6) in calibrated positions are assembled in the trigger together with a differential lever (12) actuating one of the two slides (3,4). This method is especially suited for a fully automatic assembly line.

14 Claims, 2 Drawing Sheets

METHOD OF CALIBRATING A THERMAL TRIGGER FOR AN ELECTRICAL SWITCHING DEVICE

BACKGROUND OF THE INVENTION

1. Field of the Invention

The present invention relates to a method of calibrating a thermal trigger for an electrical switching device. The method is especially useful for calibrating a thermal trigger having one bimetal strip for each phase, wherein one end of each bimetal strip is attached to the housing of the trigger, the thermal trigger also having two longitudinally displaceable positioned slides arranged in parallel, wherein the free end sections of the bimetal strips that are not attached to the inside of the housing and which bend outward under current loading in the direction of longitudinal displacement of the slides lie between both of the slides, the thermal trigger also having a differential lever which is linked to one slide via a link joint and to the other slide via a tow connection, and which acts with at least one end section upon a trigger arrangement, and the thermal trigger also having drive arms between each slide and each bimetal strip.

2. Description of Related Art

ED-A1 0302822 describes a method of the above-mentioned type. This calibration method is designed for thermal triggers with a bimetal strip for each phase with two parallel arranged longitudinally displaceable positioned slides, wherein the end sections of the bimetal strips, that under current loading bend outward in a direction of longitudinal displacement of the slides, lie between the slides. A differential lever actuating a trigger arrangement with at least one end section is attached to one slide by way of a link-joint, and to the other by way of a tow connection. A sliding, relocatable slide unit is surface-mounted onto the end section of each bimetal strip enclosing it and leaving some play, and which slides on the slides in the longitudinal direction of the slides before calibration. Thereafter, the bimetal strips are heated with the appropriate calibration current using the lowest tripping current according to regulations, until the slide units that are pushed along the slides by the outward bending bimetal strips have attained the trigger point of the tripping arrangement. The slide units are attached on both slides in this position, preferably by ultrasonic welding.

The major disadvantages of this method are that this method is unsuitable for automatic assembly and that this method permits unacceptably large tolerances (because the openings of the slide units that are clinched onto the end sections of the bimetal strips enclose the bimetal strips leaving play, and the openings also do not allow for variance in thickness among the bimetal strips). In addition, undefined displacements due to slip between the slide units and the slides can occur during ultrasonic welding. Furthermore, the slide units have to be cut open after calibration, resulting in additional costs for the proper disposal of waste.

SUMMARY OF THE INVENTION

The present invention provides a method of calibrating a thermal trigger that is suitable for automatic assembly, that permits adherence to tight tolerances, that adjusts to the variances in the thickness of the bimetal strips without play, and that avoids the generation of waste during the calibration process.

These objectives are achieved by attaching one end of the bimetal strips inside the housing of the trigger and putting the bimetal strips into a calibrating position by bending the bimetal strips outward, the bending being performed by applying a predetermined calibrating current for a predetermined heating-up time, then measuring the position of the free end sections of each bimetal strip on both folded ends opposite each other, then individually fitting both of the slides with hinged drive arms, then adjusting the drive arms on each slide using a calibration device provided with stops, including the step of sluing to the previously measured calibrating position of the individual bimetal strips, then attaching the drive arms on the slides in the pre-set calibrating position, and then mounting both of the slides provided with the drive arms to the differential lever inside the thermal trigger.

Advantageously, this process is suited for fully automatic assembly. The individual process steps are carried out in separate process stations. By measuring the contact points to be calibrated on the drive arms directly at the bimetal strips, this automatically allows for the potential differences in the thickness that may be present in the bimetal strips. The very precise measurement that is required is important, as the bending out of the bimetal strips is in the range of a few tenths of millimeters. The thickness variance of the bimetal strips, which significantly affects the trigger accuracy of the trigger within a narrow tolerance range, is also provided for under this method. Automatic assembly can attain economical and short cycle times. Neither does this method generate any disposable waste products, since nothing is cutoff or taken off.

The drive arms can be part of individual brackets, whose arm is used as a drive arm that is essentially aligned perpendicular to the longitudinal direction of the slides, and the other arm, that essentially lies in the longitudinal direction of the slide, is attached to the slides, wherein the hinged bearing of each of the brackets is attached to the slides. The hinged brackets that are attached on the slides before calibration can be very accurately set into the calibration position with the stops of the calibration device. The arms lying on top of the slides can be easily attached onto the slides.

The fastening of the plastic drive arms onto the slides, which are also made of plastic, can be done with ultrasonic welding. This type of fastening is quick and is especially suited for automatic assembly.

Other objects, features, and advantages of the present invention will become apparent to those skilled in the art from the following detailed description and accompanying drawings. It should be understood, however, that the detailed description and specific examples, while indicating preferred embodiments of the present invention, are given by way of illustration and not limitation. Many modifications and changes within the scope of the present invention may be made without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout, and in which.

DESCRIPTION OF THE PREFERRED EMBODIMENTS

Figure 1:
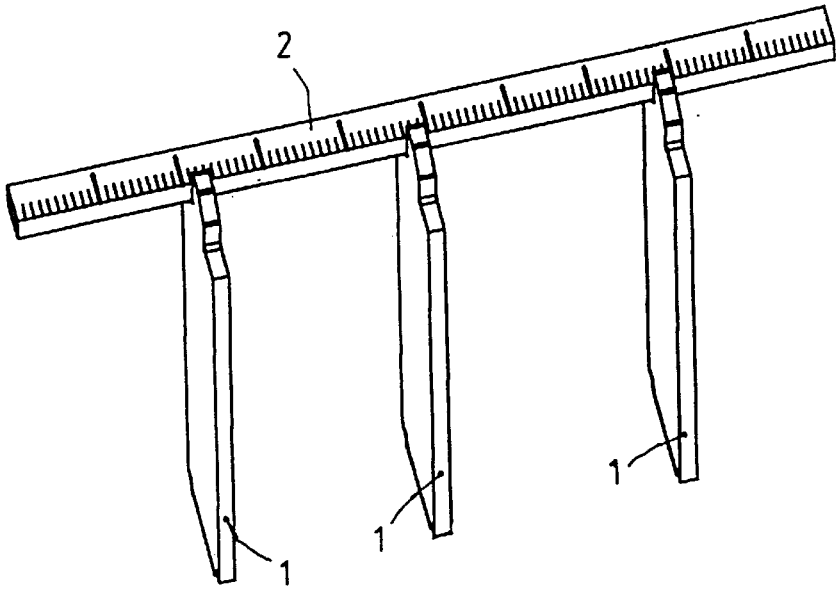
FIG. 1 is a perspective view of three bimetal strips with a schematic presentation of the measuring device, in accordance with the present invention.

FIG. 1 shows three bimetal strips 1 of a thermal trigger. The lower ends of the bimetal strips in this figure are attached to the housing of the trigger, which is not shown. For reasons of better clarity, the heating coils through which the operating current flows, that encase the bimetal strips and which heat-up in dependence of the operating current, are also not shown. In FIG. 1, the upper free ends of the bimetal strips 1 are provided for the mechanical actuation of the trigger. In order to be able to calibrate the trigger, the bimetal strips 1 are put into a calibrating position by applying a predetermined calibrating current during a predetermined time. The calibrating current is usually chosen in such a way, that after a 2 minute heating-up, the bending of the bimetal amounts to a factor of 1, 2× the nominal current of the trigger value during a heating-up period of two hours.

In the calibrating position, the positioning of the free ends of each bimetal strip 1 is measured on both folded ends opposite each other. This measurement can be done with a known measuring method, e.g., optical. In FIG. 1, this measurement is indicated with a scale 2 purely symbolically. The measured values are transmitted to a calibration device.

Figure 5:
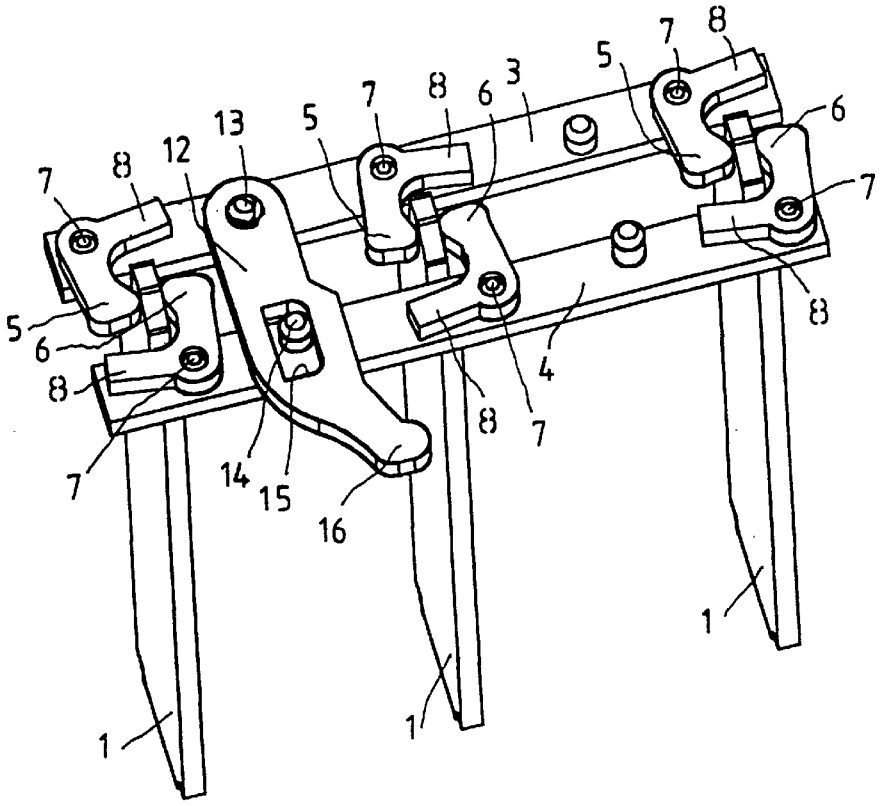
FIG. 5, is a perspective view of active parts of a calibrated and assembled thermal trigger in accordance with the present invention.

In the fully assembled trigger, the bending out of the bimetal strips acts upon two parallel-arranged, longitudinally displaceable positioned slides 3 and 4 which can be seen in FIG. 5. Both of the slides 3 and 4 can be longitudinally shifted in the bending direction of the bimetal strips 1. The trigger-actuating end sections of the bimetal strips 1 lie between both slides 3 and 4 as can be seen in FIG. 5. Drive arms 5 and 6 are positioned between each slide 3 and 4 and each bimetal strip 1. It can be seen that the position of the drive arms 5 and 6 and the position of the trigger-affecting end sections of the bimetal strips 1 determine the trigger accuracy of the trigger.

Figure 2:
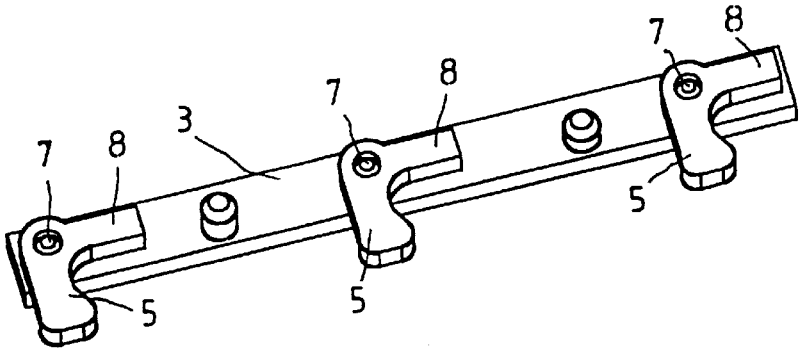
FIG. 2 is a perspective view of a slide fitted with hinged drive arms in accordance with the present invention.
Figure 3:
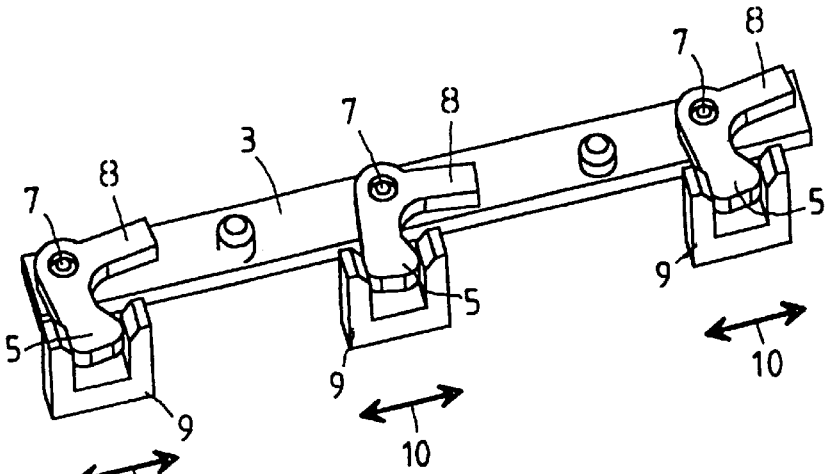
FIG. 3 is a schematic presentation of the calibration device with a slide in accordance with the present invention.
Figure 4:
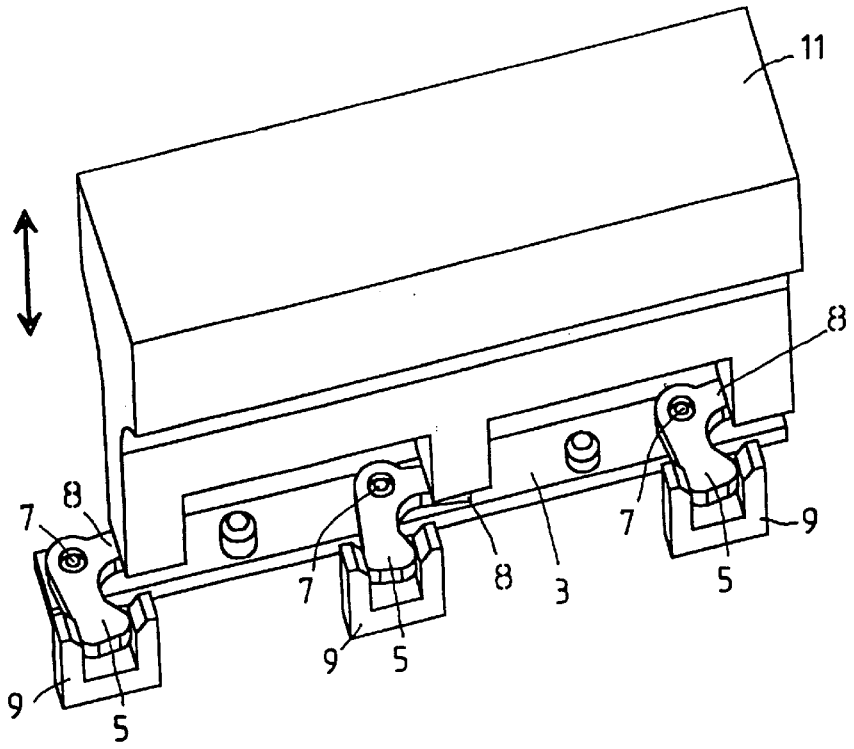
FIG. 4 is a perspective view of a slide with an ultrasonic welding device in accordance with the present invention.

In order to locate the drive arms 5 and 6 into the right position on the slides, the slides 3 and 4 are initially fitted with hinged drive arms 5 and 6. Only one slide 3 is represented in FIGS. 2, 3, and 4. However, these figures also apply for the other slide 4, because slides 3 and 4 and also the drive arms 5 and 6 are identically developed. The drive arms 5 and 6 are part of individual brackets. The drive arms 5 and 6 stand essentially perpendicular to the longitudinal direction of the slides 3 and 4. The center of gravity 7 of the brackets lies in their top sections. The other arm 8 of the brackets lies essentially in the longitudinal direction of slides 3 and 4 and is attached to slide 3 during the calibration process.

The slide 3, which is equipped with hinged trigger arms 5, is secured in a calibration device which is schematically shown in FIG. 3. The end sections of the trigger arms 5 are intercepted by U-shaped stops 9. These stops 9 will bring the drive arms 5 into the previously measured calibrating position of the respective bimetal strips 1 by shifting them into the direction of the arrow 10. As soon as the calibrating position of the drive arms 5 has been reached, the other arms 8 of the brackets are welded to slide 3 with an ultrasonic welding device 11, as schematically shown in FIG. 4.

The slides 3 and 4 which are equipped with rigidly attached drive arms 5 and 6 are fitted into the trigger later, as shown in FIG. 5. On one slide 3, a differential lever 12 is positioned at point 13 by way of a link-jointed bearing. The differential lever 12 essentially stands traversal to the direction of longitudinal shift of the slides 3 and 4. The differential lever 12 is coupled to the other slide 4 via a tow connection through bolt 14. Bolt 14 is guided in an oversized recess 15 in the differential lever 12.

When there is an equal overload across all three phases, the bimetal strips 1 are bent outward equally into the same direction. At the same time, the end section 16 of the differential lever 12 is shifted actuating a trigger arrangement, which is not shown, for example, a switch lock. With asymmetrical currents, the bimetal strips 1 are bent outward unequally, and the slides 3 and 4 are shifted dissimilarly. The end section 16 of the differential lever 12 is again shifted, which actuates the trigger arrangement.

Many other changes and modifications may be made to the present invention without departing from the spirit thereof. The scope of these and other changes will become apparent from the appended claims.

We claim:

1. A method of calibrating a thermal trigger for an electrical switching device, the thermal trigger having a bimetal strip for each phase, one end of each bimetal strip being attached to the housing of the thermal trigger, the thermal trigger having two longitudinally displaceable positioned slides arranged in parallel, wherein the free end sections of the bimetal strips that are not attached to the housing and which bend outward under current loading in the direction of longitudinal displacement of the slides lie between both of the slides, the thermal trigger having a differential lever which is linked to one slide via a link joint and to the other slide via a tow connection, and which acts with at least one end section upon a trigger arrangement, and the thermal trigger having drive arms between each slide and each bimetal strip, the method comprising the steps of: attaching one end of the bimetal strips inside the housing of the trigger and putting the bimetal strips into a calibrating position by bending the bimetal strips outward, the bending being performed by applying a predetermined calibrating current for a predetermined heating-up time, then measuring the position of the free end sections of each bimetal strip on both folded ends opposite each other, then individually fitting both of the slides with hinged drive arms, then adjusting the drive arms on each slide using a calibration device provided with stops, including the step of sluing to the previously measured calibrating position of the individual bimetal strips, then attaching the drive arms on the slides in the pre-set calibrating position, and then mounting both of the slides provided with the drive arms to the differential lever inside the thermal trigger.

2. A method according to claim 1, wherein the drive arms each are part of individual brackets, wherein the drive arms are aligned substantially perpendicularly to the longitudinal direction of the slides, wherein the brackets also include attachment arms that are aligned substantially in the longitudinal direction of the slides and are attached to the slides, and wherein the brackets each have a hinged bearing on the slides which is selected in the top range of the brackets before attachment.

3. A method according to claim 2, wherein the brackets are formed of plastic, wherein the slides are formed of plastic, and wherein the attaching of the brackets onto the slides is performed by ultrasonic welding.

4. A method according to claim 1, wherein the drive arms are formed of plastic, wherein the slides are formed of plastic, and wherein the attaching of the drive arms onto the slides is performed by ultrasonic welding.

5. A thermal trigger manufactured using the calibrating method according to claim 1.

6. A method of calibrating a thermal trigger for an electrical switching device during assembly of the electrical switching device, the thermal trigger having a bimetal strip which bends in response to current loading and a slide which moves in response to the bending of the bimetal strip, the method comprising the steps of putting the bimetal strip into a calibrated position by applying a predetermined calibrating current for a predetermined time; then measuring the calibrated position of a free end of the bimetal strip; then fitting the slide with a hinged drive arm; then adjusting the drive arm on the slide using a calibration device, including the step of sluing the drive arm to a position which corresponds to the calibrated position of the bimetal strip; and then attaching the drive arm to the slide in the position which corresponds to the calibrated position of the bimetal strip.

7. A method according to claim 6, wherein the drive arm is part of a bracket, wherein the drive arm is aligned substantially perpendicularly to the longitudinal direction of the slide, wherein the bracket also includes an attachment arm that is aligned substantially in the longitudinal direction of the slide and is attached to the slide, and wherein the bracket has a hinged bearing on the slide which permits adjustment of the drive arm before the drive arm is attached to the slide.

8. A method according to claim 6, wherein the drive arm is formed of plastic, wherein the slide is formed of plastic, and wherein the attaching step is performed by ultrasonic welding.

9. A thermal trigger manufactured using the calibrating method according to claim 6.

10. A method of calibrating a thermal trigger for a multi-phase electrical switching device, the method comprising the steps of:

providing first and second parallel longitudinally displaceable slides;

attaching a bimetal strip for each phase to a housing of the thermoelectric trigger, each bimetal strip bending under current loading in the direction of longitudinal displacement of the first and second slides, a first end of each bimetal strip being attached to the housing of the thermal trigger and a second end of each bimetal strip being left free, the second end of each bimetal strip being disposed between the first and second slides;

linking a differential lever to the first slide via a link joint and to the second slide via a tow connection, the differential lever acting with at least one end section upon a trigger arrangement when at least one of the bimetal strips bends;

putting the bimetal strips into a calibrated position by bending the bimetal strips outward, the bending step being performed by applying a predetermined calibrating current for a predetermined heating-up time;

measuring the calibrated position of the second end of each bimetal strip;

fitting the first and second slides with hinged drive arms;

adjusting the drive arms on the first and second slides using a calibration device, including the step of sluing the drive arms to respective positions which correspond to the respective calibrated positions of the respective bimetal strips; and attaching the drive arms on the slides in the respective positions.

11. A method according to claim 10, wherein the drive arms each are part of individual brackets, wherein the drive arms are aligned substantially perpendicularly to the longitudinal direction of the slides, wherein the brackets also include attachment arms that are aligned substantially in the longitudinal direction of the slides and are attached to the slides.

12. A method according to claim 11, wherein the brackets are formed of plastic, wherein the slides are formed of plastic, and wherein the attaching step is performed by ultrasonic welding.

13. A method according to claim 10, wherein the drive arms are formed of plastic, wherein the slides are formed of plastic, and wherein the attaching step is performed by ultrasonic welding.

14. A thermal trigger manufactured using the calibrating method according to claim 10.

* * * * *